US011203473B1

(12) United States Patent
McGowan

(10) Patent No.: US 11,203,473 B1
(45) Date of Patent: Dec. 21, 2021

(54) COOLER DEVICE

(71) Applicant: David McGowan, Pompano Beach, FL (US)

(72) Inventor: David McGowan, Pompano Beach, FL (US)

( * ) Notice: Subject to any disclaimer, the term of this patent is extended or adjusted under 35 U.S.C. 154(b) by 0 days.

(21) Appl. No.: 15/953,909

(22) Filed: Apr. 16, 2018

Related U.S. Application Data

(60) Provisional application No. 62/485,525, filed on Apr. 14, 2017.

(51) Int. Cl.

| | |
|---|---|
| ***B65D 55/14*** | (2006.01) |
| ***B65D 81/18*** | (2006.01) |
| ***F25D 3/06*** | (2006.01) |
| ***B65D 43/16*** | (2006.01) |
| ***F25D 23/02*** | (2006.01) |

(52) U.S. Cl.
CPC ..... *B65D 55/14* (2013.01); *B65D 43/163* (2013.01); *B65D 81/18* (2013.01); *F25D 3/06* (2013.01); *F25D 23/025* (2013.01); *F25D 23/026* (2013.01); *F25D 2400/38* (2013.01)

(58) Field of Classification Search
CPC ..... B65D 55/14; B65D 43/163; B65D 81/18; F25D 3/06; F25D 23/025; F25D 23/26; F25D 2400/38
See application file for complete search history.

(56) References Cited

U.S. PATENT DOCUMENTS

| | | | | |
|---|---|---|---|---|
| 3,750,431 | A * | 8/1973 | Atkinson | E05B 37/025 70/21 |
| 3,800,571 | A * | 4/1974 | Heine | E05B 37/02 70/71 |
| 3,973,419 | A * | 8/1976 | Atkinson | A44B 19/301 70/68 |
| 4,436,214 | A * | 3/1984 | Henderson | E05G 1/005 220/475 |
| 4,724,681 | A * | 2/1988 | Bartholomew | F25D 3/06 190/18 A |
| 5,373,708 | A * | 12/1994 | Dumoulin, Jr. | A45C 5/146 280/30 |
| 5,709,114 | A * | 1/1998 | Dawson | G07C 9/00912 340/5.6 |
| 6,116,674 | A * | 9/2000 | Allison | B60R 7/04 296/37.8 |
| 6,502,656 | B2 * | 1/2003 | Weiss | A45C 5/14 180/168 |
| 6,516,641 | B1 * | 2/2003 | Segawa | E05B 13/103 292/DIG. 30 |
| 8,740,010 | B1 * | 6/2014 | Page | A45C 11/20 220/592.03 |
| 9,341,403 | B2 * | 5/2016 | Conrad | A45C 15/00 |
| 2012/0011902 | A1 * | 1/2012 | Meekma | E05B 47/0012 70/25 |

(Continued)

*Primary Examiner* — Bryan A Evans
(74) *Attorney, Agent, or Firm* — David P. Lhota, Esq.; Lhota & Associates, P.A.

(57) ABSTRACT

A cooler device having a body and lid that can be secured shut and locked against the cooler body with a combination lock, keypad lock, key operated lock or electronic lock installed on the body of the cooler or lid of the cooler and that has retractable wheels that retract into the body when the cooler is stationary and released by a spring mechanism to extend the wheels for rolling the cooler.

12 Claims, 2 Drawing Sheets

(56) References Cited

U.S. PATENT DOCUMENTS

| | | | | |
|---|---|---|---|---|
| 2014/0054299 | A1* | 2/2014 | Kamin | F25D 23/00<br>220/592.2 |
| 2015/0300727 | A1* | 10/2015 | Abbate | A45C 15/00<br>62/331 |

* cited by examiner

COOLER DEVICE

CROSS-REFERENCE TO RELATED APPLICATION

This application claims the benefit of provisional patent application Ser. No. 62/485,525 filed Apr. 14, 2017.

STATEMENT REGARDING FEDERALLY SPONSORED RESEARCH OR DEVELOPMENT

N/A

FIELD OF THE INVENTION

The present invention relates generally to a novel cooler device and more particularly, to a cooler having main body and lid that is lockable to the main body by a combination lock, key pad lock, electronic lock or key operated lock and including retractable wheels that retract into the main body when the cooler is not in use.

BACKGROUND OF THE INVENTION

Coolers for storing food, drinks or valuable items when working on a job site or visiting a park, beach or amusement park are well known. However, when a cooler is left unattended while working or participating in activities at the park, beach or amusement park, such as walking, exercising, playing or enjoying rides, items from the cooler may be stolen, a drink could be contaminated with drugs or other dangerous instrumentalities may be placed in the cooler. A cooler having a lid that could be locked to the body of the cooler would prevent or alleviate these undesirable events from happening. Coolers with padlocks are known but padlocks are accessories to the cooler that can be lost, misplaced or forgotten or require keys that can be lost or forgotten, especially when the cooler is not often used. If there existed a cooler device with an integral combination, keypad or electronic lock, the lock would be part of the cooler such that it could not be lost, misplaced or forgotten and would be readably accessible for locking the lid shut on the cooler while unattended. Such a lockable cooler would only require the user to remember the combination or keypad code or have a remote key that electronically unlocked the cooler lock, such as the remote key for an automobile. It would be desirable for such a lockable cooler device to have a key operated lock to bypass the combination, keypad or electronic lock in the event it is rendered inoperable. However, there are no known integrally lockable cooler devices having a combination, keypad or electronic lock. Therefore, there exists a need for a lockable cooler device having an integral lock that is always readily accessible. It is, therefore, to the effective resolution of the aforementioned problems and shortcomings of the prior art that the present invention is directed. The instant invention addresses this unfulfilled need in the prior art by providing a lockable cooler with an integral lock as contemplated by the instant invention disclosed herein.

U.S. Pat. No. 7,302,902 ("the '902 Patent") issued to Stillman discloses an inflatable mooring station for use with a fixed or floating platform extending over a body of water. The mooring station is attached to the platform. The mooring station includes a buoyant, inflatable body and at least one line tie. The mooring station forms two three-sided docking areas for receiving watercraft.

Coolers are also known to have wheels to make it convenient for moving. However, when a cooler with wheels is left unattended it can roll away from its designated spot. Wheels are known that can be locked, but they require the user to bend over, locate the lock and operate the lock to secure the wheel. If a cooler existed that had wheels that could be recessed into the body of the cooler and locked in place and then released and extended for use by merely pressing down on the cooler, it would provide a simple and convenient way to lock and unlock the wheels of the cooler. However, there are no known integrally cooler devices having retractable wheels that may be retracted and extended by merely pressing down on the cooler. Therefore, there exists a need for such a cooler with conveniently retractable and extendable wheels. The instant invention addresses this unfulfilled need in the prior art by providing a cooler with retractable and extendable wheels as contemplated by the instant invention disclosed herein.

SUMMARY OF THE INVENTION

In light of the foregoing, in an aspect of the present invention to provide a cooler device having a body and lid that can be secured shut and locked against the cooler body with a combination lock, keypad lock or electronic lock installed on the body or lid of the cooler. The cooler may also include a key operated lock that bypasses the combination lock, keypad lock or electronic lock.

In another aspect, it is an object of the instant invention, to provide a cooler having a body and lid that can be secured shut and locked against the cooler body with a combination lock, keypad lock or electronic lock installed on the body or lid of the cooler and that has retractable wheels that retract into the body when the cooler is stationary and released by a spring mechanism to extend the wheels for rolling the cooler.

In a further aspect, it is object of the instant invention, to provide a cooler having a body and lid that can be secured shut and wheels that retract into the body when the cooler is stationary and released by a spring mechanism to extend the wheels for rolling the cooler.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
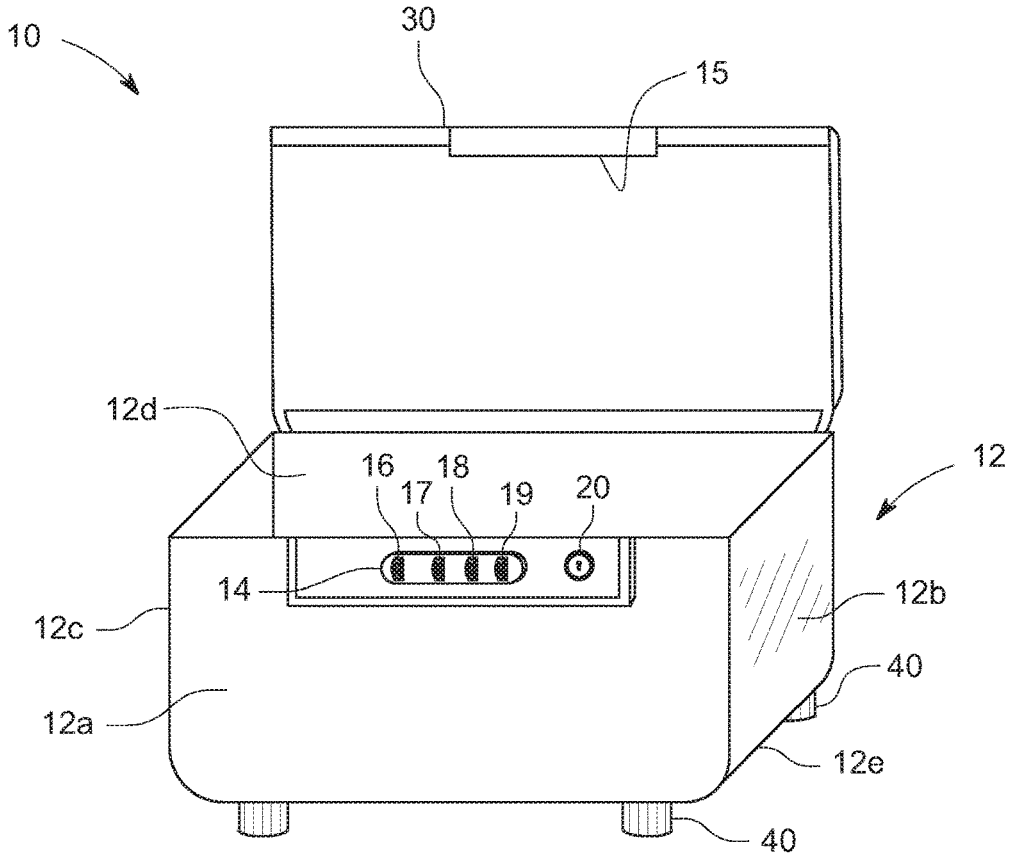
FIG. 1 is a perspective view of the integrally lockable cooler device showing the lid in an open unlocked position in accordance with the preferred embodiment of the instant invention.

With reference to the drawings in which like reference designators refer to like elements, FIGS. 1 to 4 depict the preferred and alternative embodiments of the instant invention which is generally referenced as a lockable cooler device and, or by numeric character 10. The lockable cooler device 10 has a lid 30 that can be secured shut and locked against the cooler body 12 with a combination lock 14, keypad lock or electronic lock installed on the body 12 or lid 30 of the cooler 10. The cooler 10 also includes a key operated lock 20 in the event the combination, keypad or electronic lock 14 is rendered inoperable. The cooler 10 may have or also have retractable wheels 40 that may be retracted when the cooler 10 is stationary or extended when the cooler 10 needs to be moved. The cooler wheels 40 retract or recess into the body 12 of the cooler 10 when the cooler 10 is pressed downward. The wheels 40 are released to an extended position when the cooler 10 is pressed again.

Figure 2:
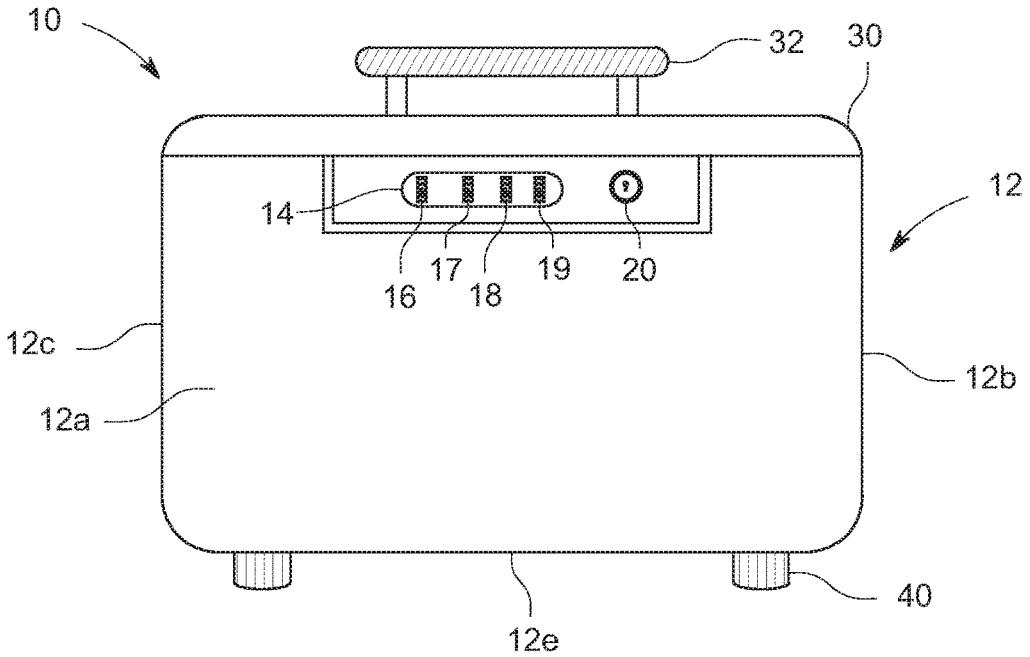
FIG. 2 is an elevational view of the integrally lockable cooler device showing the lid in a closed locked position in accordance with the preferred embodiment of the instant invention shown in FIG. 1.

With reference to FIGS. 1 and 2, in accordance with a preferred embodiment of the instant invention, the lockable cooler 10 includes a cooler body 12, combination lock 14, key-operated lock 20, lid 30 and wheels 40. The cooler body 12 comprises a front panel 12*a*, first side panel 12*b*, second side panel 12*c*, rear panel 12*d* and bottom panel 12*e* that collectively define an interior volume for storing food, drinks and valuable items. The lid 30 is hinged to the rear panel 12*d* of the cooler 10 as is known in the art. The lock 14 engages a flange 15 on the lid 30 when actuated to secure and lock the lid 30 shut and releases the flange 15 when it is unlocked. The lid lock 14 preferably comprises a combination lock 14 having a plurality of manually rotatable rings 16, 17, 18 and 19 coaxially mounted about a rotatable member, a protruding cam end of a bowed annular spring fixed in an annular groove in the member pressing outwardly against inner cylindrical surfaces of the rings 16, 17, 18 and 19. Reference marks on the rings 16-19 and on a rotatable external part of the member can be set to a combination corresponding to alignment of grooves in the inner surfaces of the rings 16-19 with the cam, in which case the cam engages in the grooves and locks one of the rings for rotation with the member. The other grooves each have a profile such that their ring 16-19 does not lock for rotation with the member, so that rotation of these rings 16-19 causes retraction of the cam from the grooves. When the combination of reference marks are not properly selected and aligned the lock 14 is engaged with and blocks the flange 15 from movement such that the lid 30 cannot be opened, as shown in FIG. 2. When the reference marks are properly selected and aligned the lock 14 disengages and releases the flange 15 so the lid 30 may be opened, as shown in FIG. 1. When the lock 14 is a keypad lock, then the proper combination of keys must be pressed or entered to release the lock cam or latch from the flange 15. When the lock 14 is an electronic remotely operated lock, the lock cam or latch is released from the latch 15 when the remote key is actuated, sending an electronic signal to the lock 14 for unlocking. Similarly, the lock 14 is remotely locked when the remote key is actuated, causing the cam or latch to engage the flange 15. The lockable cooler device 10 preferably includes a key-operated lock 20 that bypasses the combination, keypad or remote lock 14 in the event they are rendered inoperable . . . .

Figure 3:
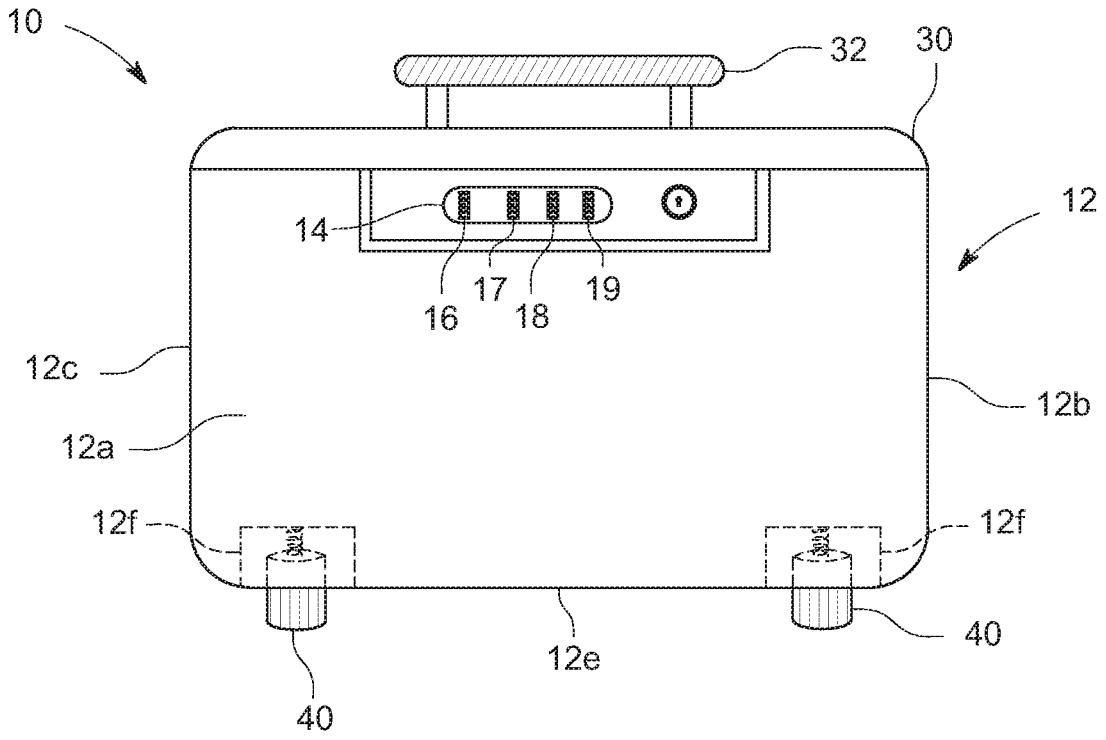
FIG. 3 is an elevational view of the lockable cooler device with retractable wheels in accordance with the preferred embodiment of the instant invention.
Figure 4:
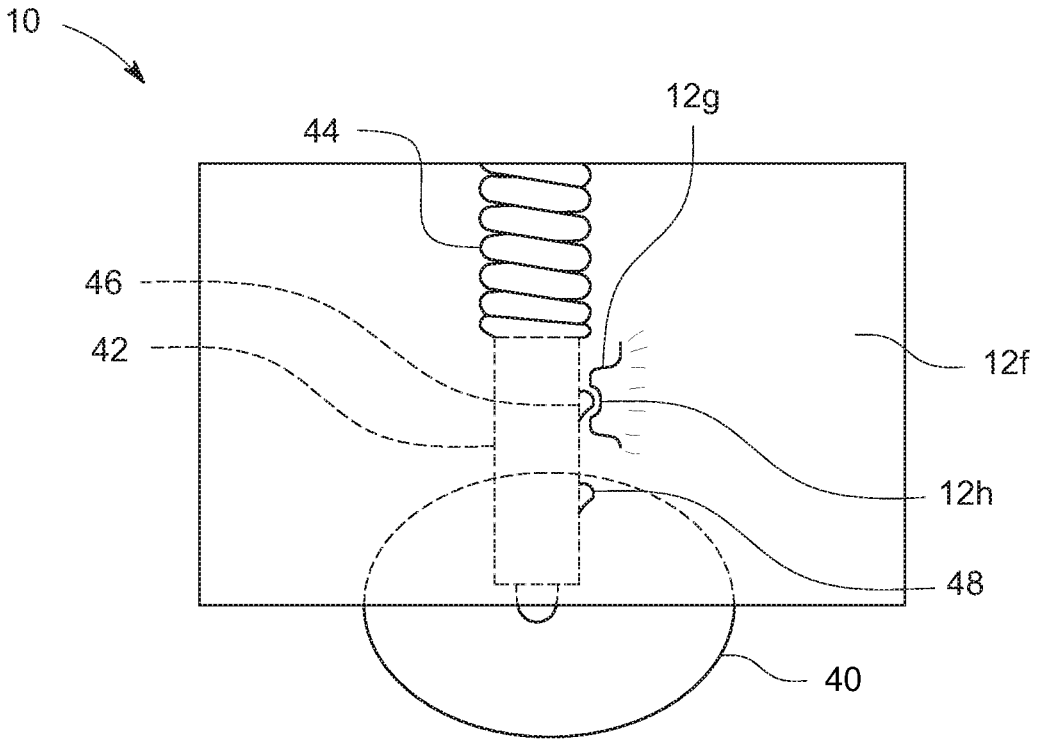
FIG. 4 is an elevational view of the retractable wheel of the lockable cooler device in accordance with the preferred embodiment of the instant invention.

With reference to FIGS. 3 and 4, the lockable cooler 10 may include wheels 40 that retract into the cooler body 12 when not in use and extend from the body 12 when ready for use. The wheels 40 are spring loaded or connected to a spring-loaded device 44 by a linkage arm 42 that is connected to the wheel 40 at one end and the spring 44 at an opposite end. The linkage arm 42 has a pair of spring-loaded pins or pliable pins 46, 48 that engage a cooler panel locking groove 12*h* defined by a locking flange 12*g* on the inside of one or more of the cooler body side panels 12.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A cooler device comprising:

a body having a front panel, a rear panel, a first side panel, a second side panel and a bottom panel defining an interior volume and an open top end;

a hinged lid pivotally mounted along a hinged edge to one of said panels so as to selectively facilitate access to said open top end and said interior volume;

a coded lock assembly disposed on the body such that it engages a flange on said lid to selectively lock to the lid so as to prevent pivoting said lid away from said body, said coded lock assembly having a coded configuration necessitating a coinciding code to unlock said coded lock assembly to facilitate pivoting said lid away from a panel opposite said panel supporting said hinged edge of said lid;

a mechanical key operated lock disposed on the body such that it engages said flange on said lid to selectively engage and release said flange; and at least one retractable wheel assembly mounted to said body, said at least one retractable wheel assembly including:

a spring;

a linkage arm engaging said spring at a first end and engaging said retractable wheel at a second end, said spring engaging said body at a first end and said linkage arm at a second end;

a pair of spring-loaded pins disposed on said linkage arm in alignment;

a locking flange support in said body; and a locking groove defined in said locking flange for engaging one of said pair of spring-loaded pins when said linkage arm is in a first retracted position and a second one of said pair of spring-loaded pins when said locking flange is in an extended position.

2. The cooler device of claim 1, wherein said lid is hinged to said rear panel.

3. The cooler device of claim 1, wherein said coded lock assembly comprises:

an electronic key pad operated lock.

4. The cooler device of claim 1, wherein said coded lock assembly comprises:

an electronic lock.

5. The cooler device of claim 1, wherein said at least one retractable wheel assembly recesses into said body.

6. The cooler device of claim 1, wherein said at least one retractable wheel is spring-loaded and has a locking mechanism.

7. The cooler device of claim 1, wherein said mechanical key operated lock bypasses said coded lock assembly.

8. The cooler device of claim 1, wherein said mechanical key operated lock bypasses said coded lock assembly.

9. The cooler device of claim 4, wherein said mechanical key operated lock bypasses said electronic lock.

10. The cooler device of claim 1, further comprising a plurality of said at least one retracted wheel assembly.

11. The cooler device of claim 10, wherein said body comprises an insulated material.

12. The cooler device of claim 1, wherein said body comprises an insulated material.

* * * * *